US005906179A

United States Patent [19]

Capdevila

[11] Patent Number: 5,906,179

[45] Date of Patent: May 25, 1999

[54] HIGH EFFICIENCY, LOW SOLIDITY, LOW WEIGHT, AXIAL FLOW FAN

[75] Inventor: Hugo Capdevila, London, Canada

[73] Assignee: Siemens Canada Limited, Chatham, Canada

[21] Appl. No.: 08/883,827

[22] Filed: Jun. 27, 1997

[51] Int. Cl.[6] ..... F01P 7/10

[52] U.S. Cl. ..... 123/41.49; 416/169 A; 416/223 R; 416/DIG. 5

[58] Field of Search ..... 123/41.49; 416/169 A, 416/189, 192, 223 R, 228, DIG. 5

[56] References Cited

U.S. PATENT DOCUMENTS

| | | | |
|---|---|---|---|
| 16,517 | 2/1857 | Marshall . | |
| 562,020 | 6/1896 | Peabody . | |
| 1,062,258 | 5/1913 | Schlotter . | |
| 1,408,715 | 3/1922 | Seelig et al. . | |
| 1,795,588 | 3/1931 | Wilson . | |
| 1,993,158 | 3/1935 | Funk . | |
| 2,154,313 | 4/1939 | McMahan . | |
| 2,219,499 | 10/1940 | Troller et al. . | |
| 2,628,019 | 2/1953 | Koch . | |
| 2,687,844 | 8/1954 | Woodward . | |
| 3,168,235 | 2/1965 | Valdi . | |
| 3,173,604 | 3/1965 | Sheets et al. . | |
| 3,481,534 | 12/1969 | Price . | |
| 3,680,977 | 8/1972 | Rabouyt et al. | 415/172 |
| 3,995,970 | 12/1976 | Nobuyukis | 415/119 |
| 4,181,172 | 1/1980 | Longhouse | 165/51 |
| 4,329,946 | 5/1982 | Longhouse | 123/41.49 |
| 4,358,245 | 11/1982 | Gray | 416/139 |
| 4,396,351 | 8/1983 | Hayashi et al. | 415/172 |
| 4,459,087 | 7/1984 | Barge | 417/356 |
| 4,548,548 | 10/1985 | Gray, III | 416/189 |
| 5,244,347 | 9/1993 | Gallivan et al. | 416/189 |
| 5,326,225 | 7/1994 | Gallivan et al. | 416/179 |
| 5,399,070 | 3/1995 | Alizadeh | 416/189 |

FOREIGN PATENT DOCUMENTS

| | | | |
|---|---|---|---|
| 2913922 | 10/1980 | Germany . | |
| 1150409 | 4/1985 | U.S.S.R. | 415/211.2 |

*Primary Examiner*—Noah P. Kamen

[57] ABSTRACT

A high efficiency, low solidity, low weight, axial flow fan (100, 200, 300) includes a hub (102, 202, 302), fan blades (104, 204, 304) and a circular band (106, 206, 306). The hub (102, 202, 302) rotates about a rotational axis (110, 210, 310) when torque is applied from a shaft (not shown) rotatably driven by a power source (not shown). The circular band (106, 206, 306) is concentric with the hub (102, 202, 302) and is spaced radially outward from the hub. The blades (104, 204, 304) are distributed circumferentially around the hub (102, 202, 302) and extend radially from the hub to the circular band (106, 206, 306). The blades (104, 204, 304) are configured to produce an airflow when rotated about the rotational axis (110, 210, 310). Each blade (104, 204, 304) has a chord length distribution which varies along the length of the blade, such that the chord length has a local minimum value at a predetermined location between the ends of the blade. The chord length of the blades (104, 204, 304) as a function of blade radius from the rotational axis (110, 210, 310) has an inflection point at a predetermined distance from the hub less than the length of the blade.

33 Claims, 13 Drawing Sheets

HIGH EFFICIENCY, LOW SOLIDITY, LOW WEIGHT, AXIAL FLOW FAN

FIELD OF THE INVENTION

The invention generally relates to axial flow fans. The invention particularly relates to a high efficiency, low solidity, low weight, axial flow fan having an improved blade shape wherein the chord length has a local minimum value at a predetermined location between the ends of the blade.

BACKGROUND OF THE INVENTION

An axial flow fan may be used to produce a flow of cooling air through the engine compartment of a vehicle. For example, an airflow generator used in an automotive cooling application may include an axial flow fan for moving cooling air through an air-to-liquid heat exchanger such as an engine radiator, condenser, intercooler, or combination thereof. The required flow rate of air through the fan and change in pressure across the fan vary depending upon the particular cooling application. For example, different vehicle types or engine models may have different airflow requirements, and an engine radiator may have different requirements than an air conditioner.

To provide adequate cooling, a fan should have performance characteristics which meet the flow rate and pressure rise requirements of the particular automotive application. For example, some applications impose low flow rate and high pressure rise requirements while other applications impose high flow rate and low pressure rise requirements. The fan must also meet the dimensional constraints imposed by the automotive engine environment, which is typically non-ducted. Known fans which meet such aerodynamic requirements and dimensional constraints typically have relatively high solidity values and weight.

Critical performance characteristics of a fan can be represented by two curves, a static pressure curve and an efficiency curve. A static pressure curve is obtained by plotting the static pressure across the fan as a function of the volume flow rate through the fan. Generally, the static pressure curve of known fans can be approximated by a second or third order equation with a predominantly negative slope. The maximum pressure rise occurs at a low flow rate and the minimum pressure at a high flow rate.

The efficiency curve plots the static fan efficiency as a function of the volume flow rate through the fan. Generally, the curve of known fans can be approximated by a second order equation with a local maximum. Typically the local maximum forms a relatively sharp peak at an intermediate flow rate. The narrow range of volume flow rate over which peak efficiency is maintained limits the range of automotive applications that can be served compared to a fan with a similar peak value of efficiency but having a broad and flat efficiency curve.

Accordingly, it would be desirable to provide an improved fan for moving air with high efficiency, low solidity and low weight. It would also be desirable to provide an axial flow fan having low solidity and low weight which has performance characteristics meeting the requirements imposed by various automotive applications. Further, it would be desirable to provide an axial flow fan having a relatively broad and flat efficiency curve. In addition, it would be desirable to provide a fan capable of covering a broad range of automotive applications.

SUMMARY OF THE INVENTION

The invention relates to a fan rotatable about a rotational axis including a plurality of radially-extending fan blades configured to produce an airflow when rotated about the rotational axis. Each blade has a chord length distribution which varies along the length of the blade, wherein the chord length has a local minimum value at a predetermined location between the ends of the blade.

The invention also relates to a fan including a hub rotatable about a rotational axis and a plurality of fan blades extending radially from the hub and configured to produce an airflow when rotated about the rotational axis. Each blade has a chord length distribution which varies along the length of the blade, wherein the chord length, as a function of blade radius from the rotational axis, has an inflection point at a predetermined distance from the hub less than the length of the blade.

Further, the invention relates to a fan including a hub rotatable about a rotational axis and a plurality of fan blades extending radially from the hub and configured to produce an airflow when rotated about the rotational axis. Each blade has a chord length distribution which varies along the length of the blade, wherein the second derivative of the chord length, as a function of blade radius from the rotational axis, is substantially equal to zero at a predetermined distance from the hub less than the length of the blade.

The invention also relates to a high efficiency, low solidity, low weight, axial flow fan for producing an airflow through an engine compartment of a vehicle. The fan includes a hub rotatable about a rotational axis, a circular band concentric with the hub and spaced radially outward from the hub, and four or five fan blades distributed circumferentially around the hub and extending radially from the hub to the circular band. Each blade has substantially the parameters defined by a particular set of values for R (the radial distance from the rotational axis), $R/R_{tip}$ (the dimensionless radial distance based on blade tip section radii), C (the chord length of the blade at the radial distance R), $\epsilon$ (the stagger angle of the blade at the radial distance R), $\theta$ (the camber angle of the blade at the radial distance R), and a (the solidity C/S, S being the circumferential blade spacing, at the radial distance R).

In addition, the invention relates to a vehicle cooling system including a heat exchanger configured to transfer heat from a vehicle system and a powered fan configured to move air past the heat exchanger. The fan includes radially-extending fan blades configured to produce an airflow when rotated about a rotational axis. Each blade has a chord length distribution which varies along the length of the blade, wherein the chord length has a local minimum value at a predetermined location between the ends of the blade.

The invention also relates to a vehicle cooling system including a heat exchanger configured to transfer heat from a vehicle system and a powered fan configured to move air past the heat exchanger. The fan includes a hub rotatable about a rotational axis and a plurality of fan blades extending radially from the hub and configured to produce an airflow when rotated about the rotational axis. Each blade has a chord length distribution which varies along the length of the blade, wherein the chord length, as a function of blade radius from the rotational axis, has an inflection point at a predetermined distance from the hub less than the length of the blade.

BRIEF DESCRIPTION OF THE DRAWINGS

The invention will become more fully understood from the following detailed description of the preferred embodiments thereof, taken in conjunction with the accompanying drawings, wherein like reference numerals refer to like parts, in which.

DETAILED DESCRIPTION OF THE PREFERRED EMBODIMENTS

The following is a detailed description of three embodiments of the fan of the present invention. It should be understood that alternative embodiments may be adapted or selected for use in various applications.

Figure 1:
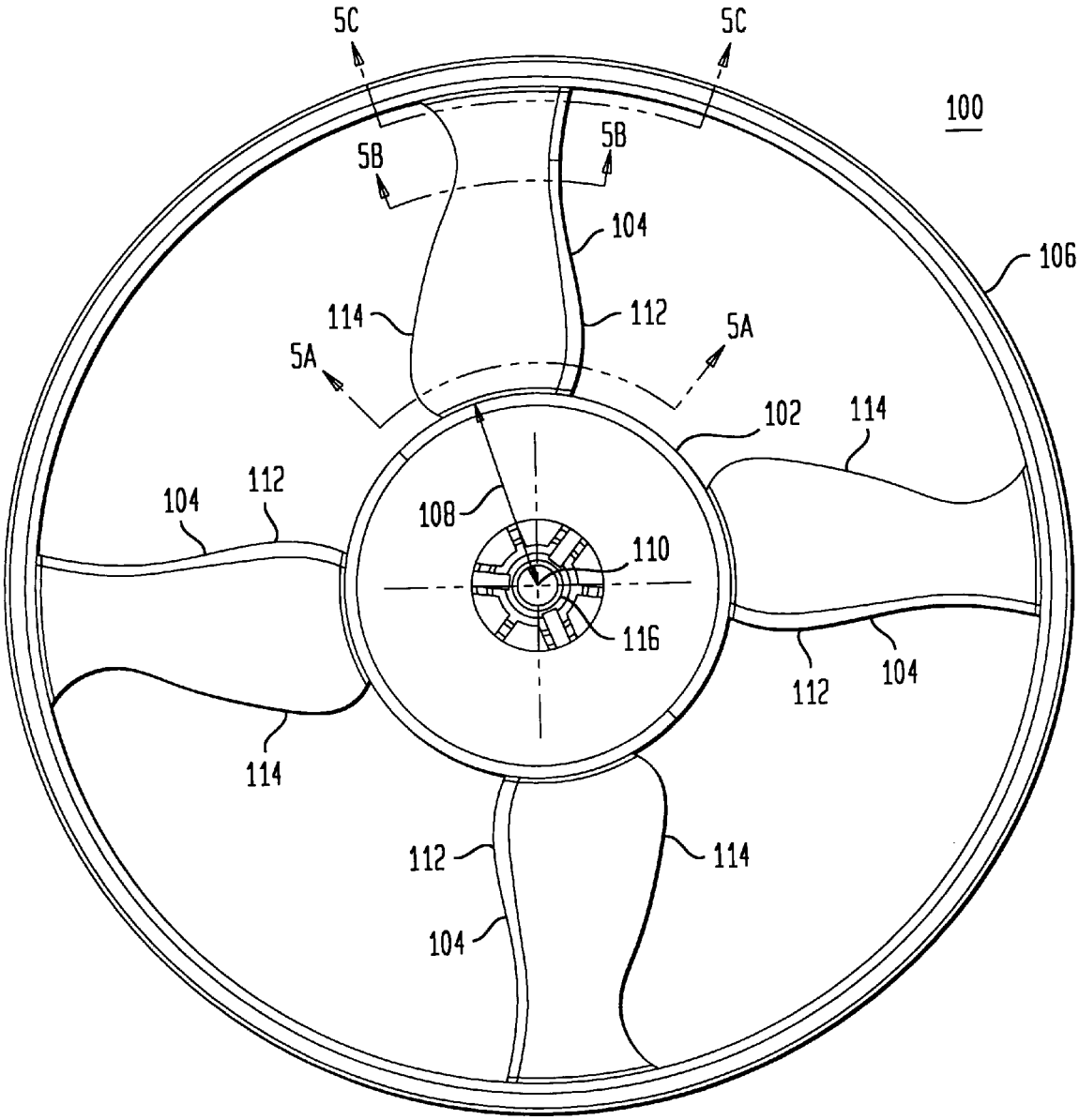
FIG. 1 is a front view of a first embodiment of a fan including a hub, fan blades and a circular band.

A first embodiment of a fan 100 in accordance with the present invention is shown in FIGS. 1 through 5C. Referring to FIG. 1, fan 100 includes a circular hub 102, four fan blades 104 and a circular band 106. Hub 102 is concentric to a rotational axis 110 and has a radius 108 extending radially from rotational axis 110. Fan blades 104 are distributed circumferentially around hub 102, and are preferably evenly spaced. Blades 104 extend radially from hub 102 to band 106, with the distance between the two ends of blades 104 referred to as blade length. The distance between rotational axis 110 and locations along blades 104 is referred to as blade section radius R. Blades 104 have a leading edge 112, a trailing edge 114, and a shape configured to produce an airflow when fan 100 is rotated about rotational axis 110.

In general, fan 100 is supported and securely coupled to a shaft (not shown) passing fully or partially through an aperture 116 in hub 102. Alternatively, the shaft may be securely coupled to fan 100 by other means, such as a screw passing through hub 102 along rotational axis 110 and into the shaft. The shaft is rotatably driven by a power source (not shown) such as an electric motor or vehicle engine. An appropriate gearing or transmission, such as a belt, chain or direct coupling drive, may couple the power source to the shaft.

As the shaft is rotated about rotational axis 110 by the power source, torque is applied to hub 102, blades 104 and band 106, and fan 100 rotates about rotational axis 110. Upon rotation of fan 100, blades 104 generate an airflow in a direction generally opposite to the arrow labeled "FRONT OF VEHICLE" in FIG. 2. The airflow may serve to remove heat energy from a liquid (e.g., coolant) flowing through a heat exchanger (not shown). Fan 100 may be located on the upstream or downstream side of the heat exchanger to push or pull the airflow through the heat exchanger, respectively.

Figure 2:
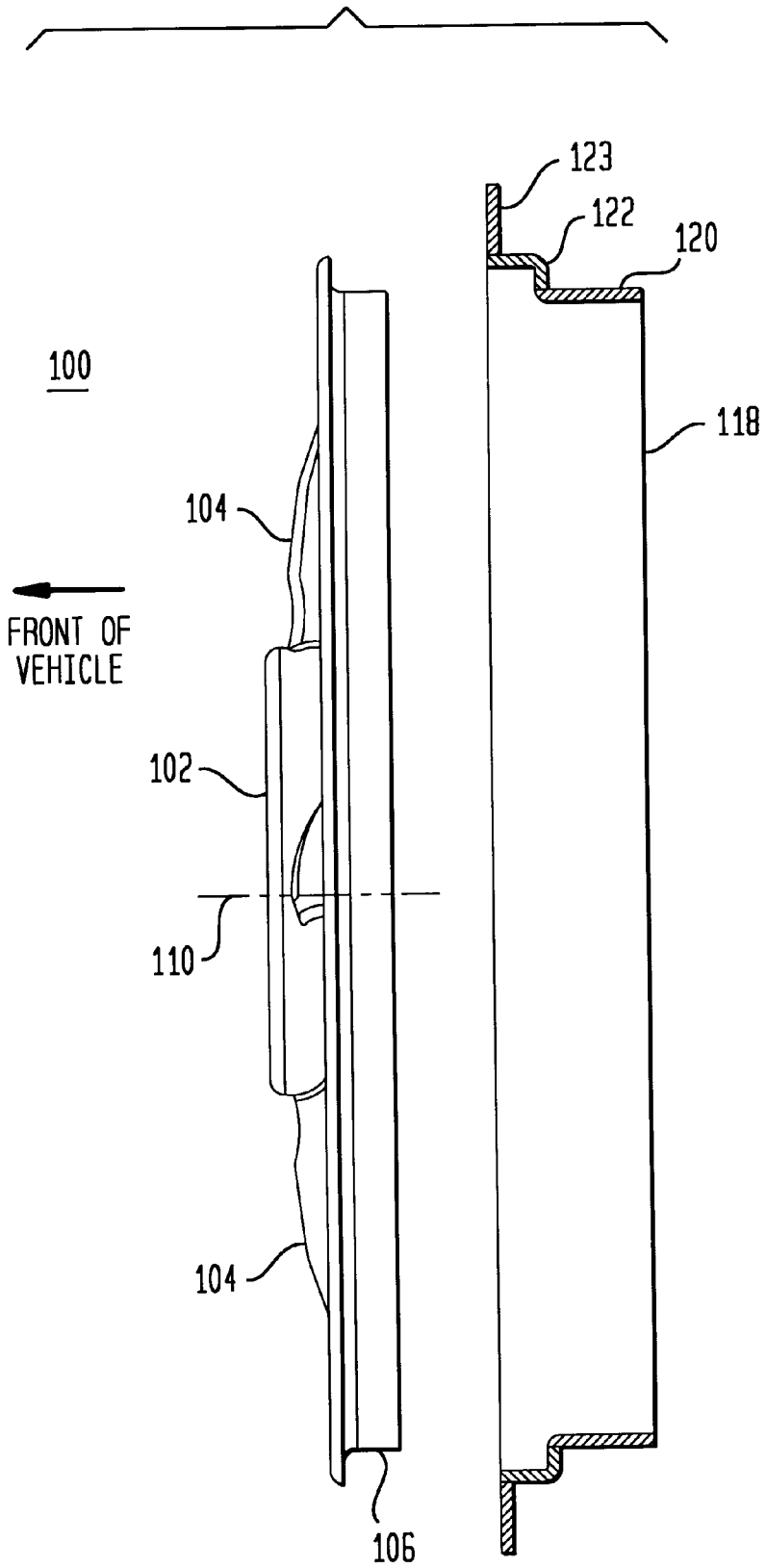
FIG. 2 is a side view of the fan shown in FIG. 1 and of a fan support for use with the fan.
Figure 4A:
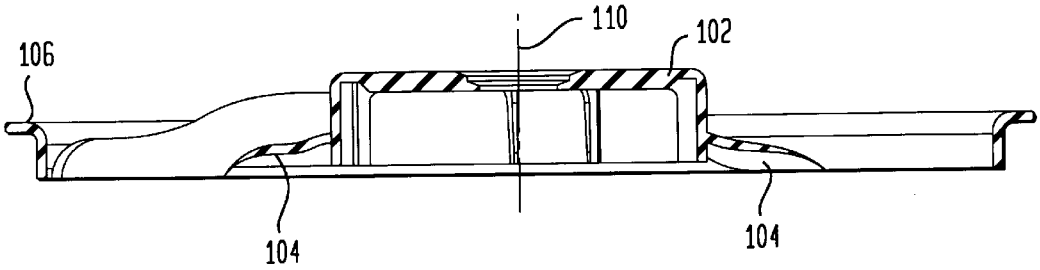
FIG. 4A is a sectional view of the hub, fan blades and circular band taken along line 4A—4A in FIG. 3.
Figure 4B:
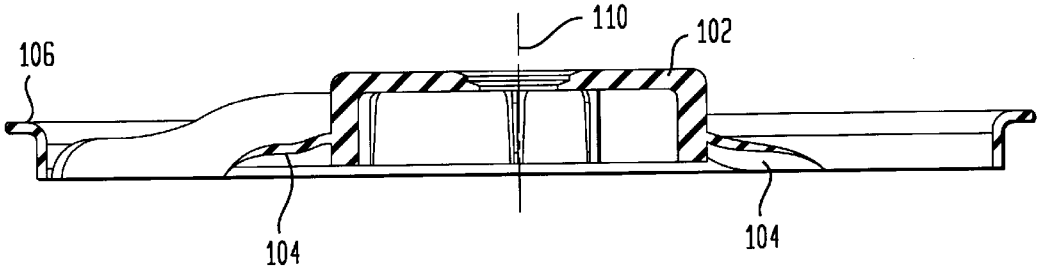
FIG. 4B is a sectional view of the hub, fan blades and circular band taken along line 4B—4B in FIG. 3.

Referring to FIG. 2, band 106 is an L-shaped circumferential ring concentric with hub 102 and spaced radially outward from the hub. As shown in FIGS. 4A and 4B, band 106 may extend partially axially from hub 102. Referring back to FIG. 2, band 106 may cooperate with a fan support 118 including a ring 120 and a circumferential flange 122 to reduce or eliminate undesirable airflow components (i.e., recirculation) between fan 100 and fan support 118. Band 106, ring 120 and circumferential flange 122 are concentric to each other when assembled, forming a mechanical seal. A flange 123 provides a location for mounting fan support 118 to a heat exchanger or vehicle structural member. Fan support 118 may include a central bearing or motor support (not shown) for mounting an electric motor.

Figure 3:
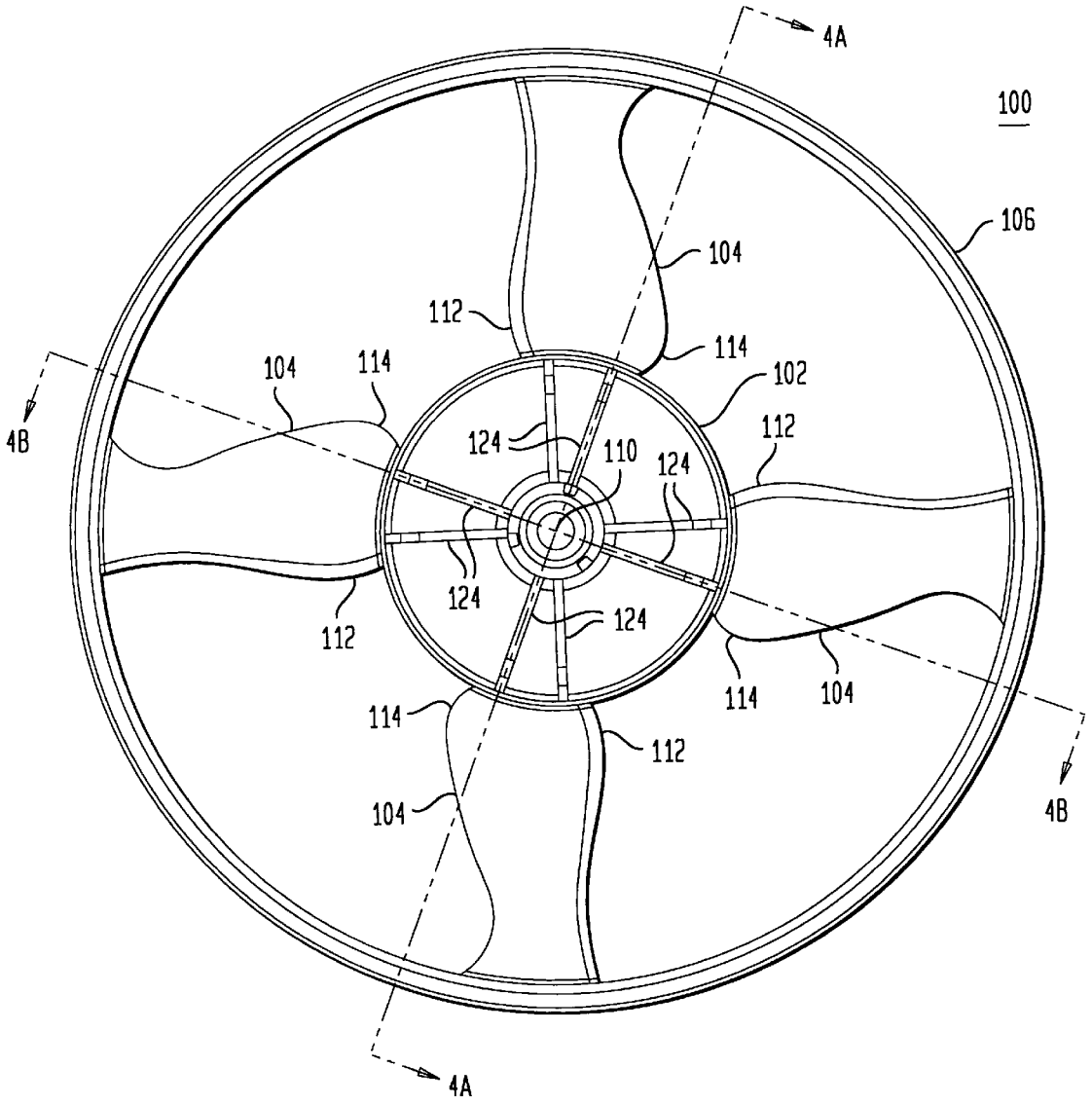
FIG. 3 is a rear view of the fan shown in FIG. 1.

Referring to FIG. 3, hub 102 includes a pair of reinforcement spars 124 located generally in the vicinity of leading edge 112 and trailing edge 114 of each blade 104. Alternatively, a different number of spars 124 could be used for each blade 104. Spars 124 provide rigidity to fan 100, which aids in reducing vibration noise during operation of fan 100. Spars 124 also control the axial displacement of blades 104 and the bend on the tip of the blades. By way of example only, fan 100 may be an integrally molded piece fabricated from polycarbonate 20% G.F. Hydex 4320, or from mineral or glass reinforced polyaimide 6/6 (e.g., Du Pont Minlon 22C®).

Figure 5A:
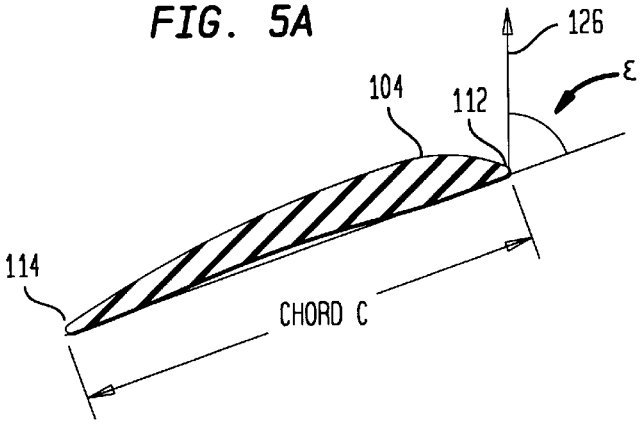
FIG. 5A is a sectional view of a fan blade taken along line 5A—5A in FIG. 1.
Figure 5B:
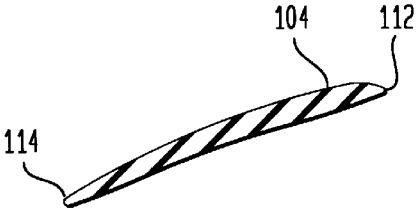
FIG. 5B is a sectional view of a fan blade taken along line 5B—5B in FIG. 1.
Figure 5C:
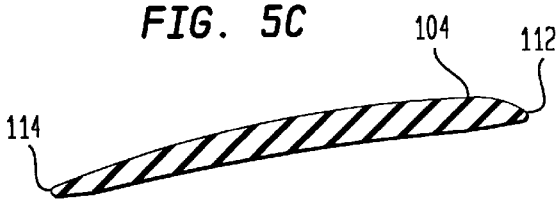
FIG. 5C is a sectional view of a fan blade taken along line 5C—5C in FIG. 1.
Figure 6:
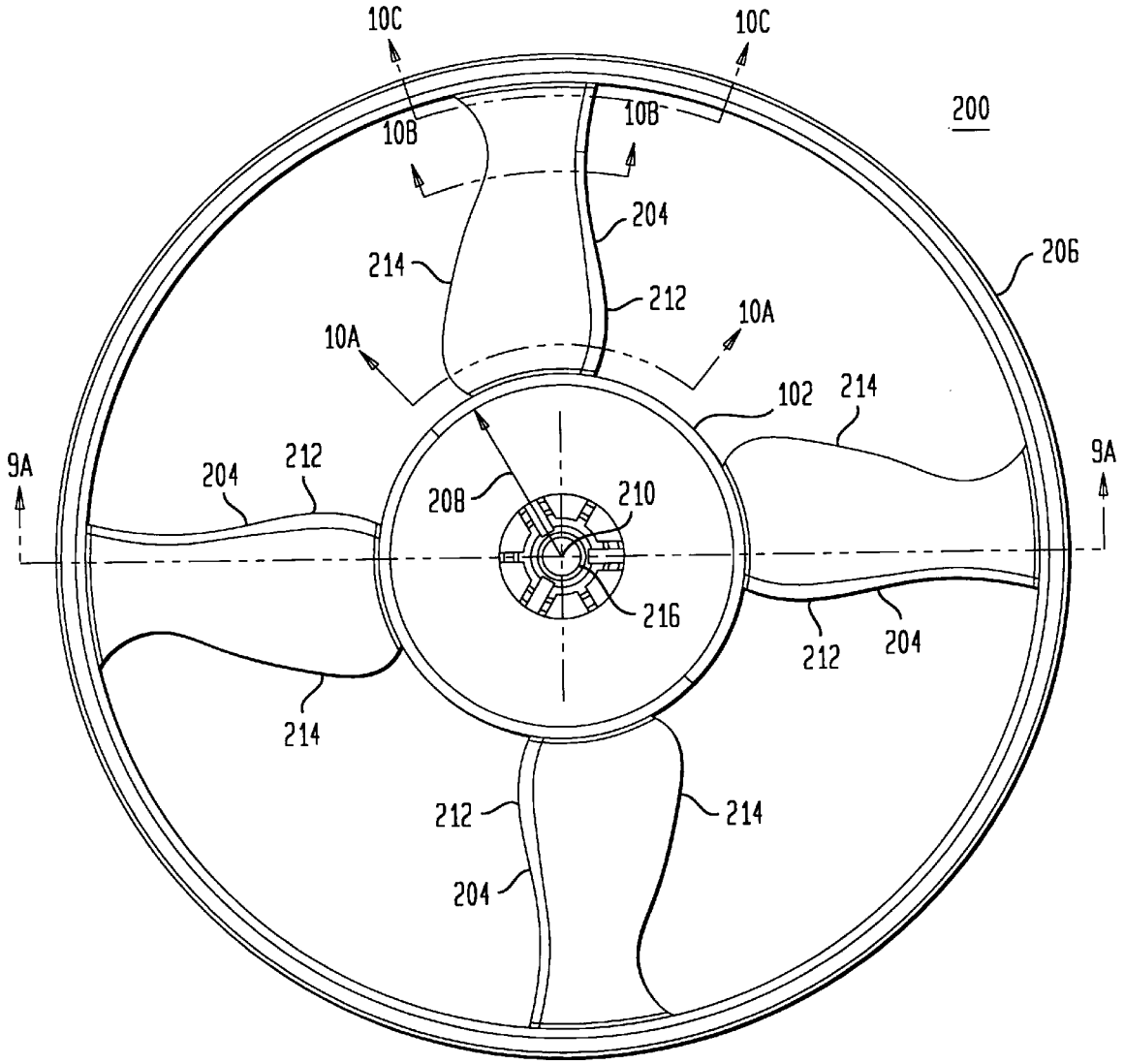
FIG. 6 is a front view of a second embodiment of a fan including a hub, fan blades and a circular band.
Figure 7:
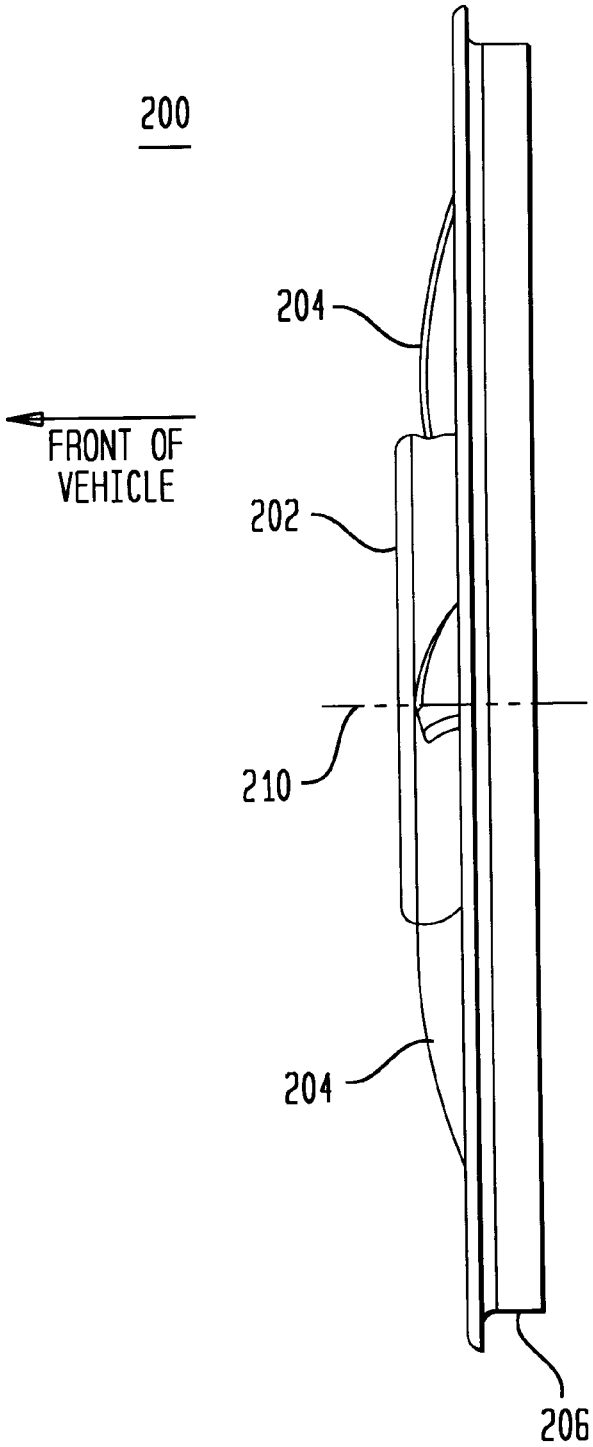
FIG. 7 is a side view of the fan shown in FIG. 6.

Blades 104 are configured to give fan 100 generally high flow rate and low pressure rise performance characteristics. Each blade 104 has a chord length, camber angle, stagger angle and cross-sectional shape which vary along the length of the blade. Sectional views of blade 104 taken along lines 5A—5A, 5B—5B, 5C—5C in FIG. 1 are shown in FIGS. 5A–5C. A chord C of each blade 104 extends from leading edge 112 to trailing edge 114. A stagger angle $\epsilon$ is the angle between a line 126 parallel with rotational axis 110 which intersects the chord and a line extending from leading edge 112 to trailing edge 114. In particular, each blade 104 has the following parameters:

TABLE I

| R (mm) | $R/R_{tip}$ | C (mm) | ϵ (deg) | Θ (deg) | σ |
|---|---|---|---|---|---|
| 75.00 | 0.40 | 56.00 | 67.63 | 19.00 | 0.48 |
| 86.19 | 0.46 | 70.11 | 67.00 | 20.00 | 0.52 |
| 99.80 | 0.53 | 76.16 | 66.73 | 24.00 | 0.49 |
| 113.56 | 0.60 | 74.00 | 67.00 | 23.00 | 0.41 |
| 127.25 | 0.67 | 66.76 | 67.80 | 22.30 | 0.33 |
| 140.94 | 0.75 | 57.58 | 69.00 | 22.00 | 0.26 |
| 157.00 | 0.83 | 49.61 | 71.00 | 21.00 | 0.20 |
| 168.31 | 0.89 | 46.00 | 73.00 | 21.00 | 0.17 |
| 182.82 | 0.97 | 49.87 | 76.39 | 21.50 | 0.17 |
| 188.84 | 1.00 | 55.59 | 78.00 | 23.00 | 0.19 |
| 196.10 | 1.04 | 65.00 | 80.00 | 24.00 | 0.21 |

wherein R is the radial distance from rotational axis 110, $R/R_{tip}$ is a dimensionless radial distance based on blade tip section radii, C is the chord length, ϵ is the stagger angle, θ is the camber angle, and σ is the solidity C/S (S being the circumferential blade spacing) at the radial distance R. As shown in Table I, the tip of the blade $R_{tip}$ is located at a distance of 188.84 mm from rotational axis 110. The quantity $R/R_{tip}$ is a dimensionless radial distance useful for comparing different fans to each other.

As shown in Table I, blades 104 have a chord length distribution which varies along the length of the blades. In particular, the chord length as a function of blade radius from rotational axis 110 has an inflection point between hub 102 and band 106 (i.e., between the ends of blades 104). Table I illustrates the chord length as a function of blade radius, and the mathematical function can be determined using an appropriate curve fitting method. Defining $R_{inf}$ as the radius at the point of inflection, $R_{hub}$ as the radius of the hub, and $R_{tip}$ as the radius at the tip of the blades, the following relationship exists:

$$R_{hub}<R_{inf}<R_{tip}$$

The inflection point is at a location along the length of blades 104 where the second derivative of the chord length as a function of blade radius is equal to zero. The following relationships also exist:

$d^2C/dR^2<0$, when $R<R_{inf}$;

$d^2C/dR^2=0$, when $R=R_{inf}$; and $d^2C/dR^2>0$, when $R>R_{inf}$

The shape of blades 104 described by the parameters in Table I, including the inflection point, is optimized to provide high efficiency, low solidity and low weight. Fan 100 also has a relatively broad and flat efficiency curve.

The chord length of blades 104 has a local minimum value at a location along the length of blades 104 between hub 102 and circular band 106. Generally, the local minimum value occurs at a location along the length of blades 104 between the ends of blades 104 where the first derivative of chord length as a function of blade radius is equal to zero. Thus, the local minimum value occurs at a location where:

$$dC/dR=0$$

Furthermore, for the embodiment of the fan characterized by the parameters of Table I, and for the fan embodiments characterized by the parameters of Tables II and III described below, the inflection point occurs at a location closer to hub 102 than the location of the local minimum chord length (FIG. 1).

As can be seen from Table I, the solidity value of fan 100 is relatively low, ranging between 0.17 and 0.52 at different values of radial distance R. The solidity of fan 100 at each radial distance R can be represented using the ratio C/S, wherein C is the chord length and S is the circumferential blade spacing at the radial distance R. The low solidity value is a factor in the increased efficiency and decreased weight of fan 100 in comparison to other fans with similar performance characteristics. The low solidity value of fan 100 is also advantageous under ram air conditions. For example, fan 100 is capable of providing an adequate cooling air flow when a vehicle is stopped or moving slowly and little or no air is being forced through the engine compartment of the vehicle by virtue of vehicle movement. As the vehicle speeds up and air is forced through the engine compartment, the low solidity of fan 100 allows the forced air to pass easily through fan 100 with little resistance to the ram air component.

A second embodiment of a fan 200 in accordance with the present invention is shown in FIGS. 6 through 10C. The description of fan 200 is generally similar to fan 100, except as discussed herein. The reference numerals in FIGS. 6 through 10 generally correspond to the reference numerals in FIGS. 1 through 5C, except that the numerals start at a base of 200 rather than 100.

Figure 8:
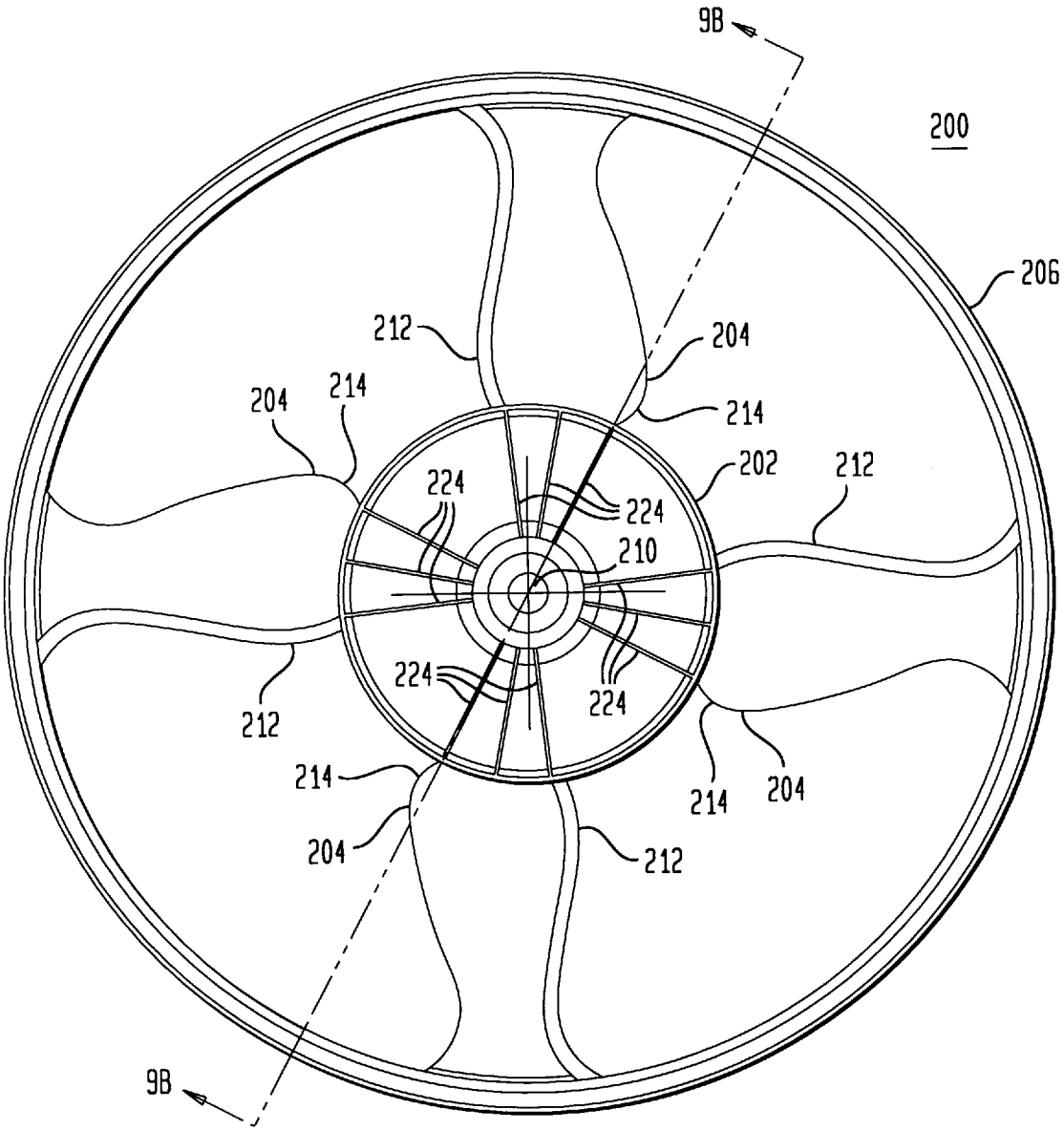
FIG. 8 is a rear view of the fan shown in FIG. 6.
Figure 9A:
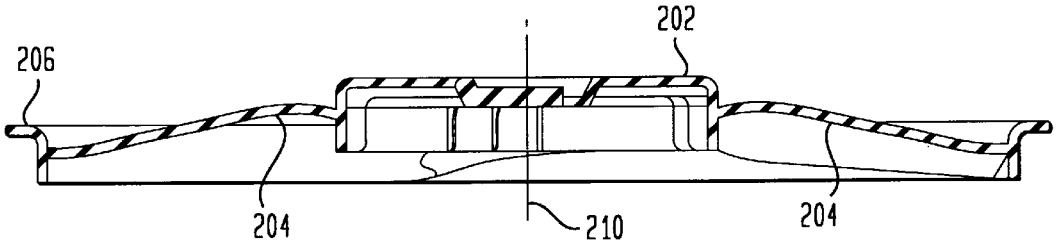
FIG. 9A is a sectional view of the hub, fan blades and circular band taken along line 9A—9A in FIG. 6.
Figure 9B:
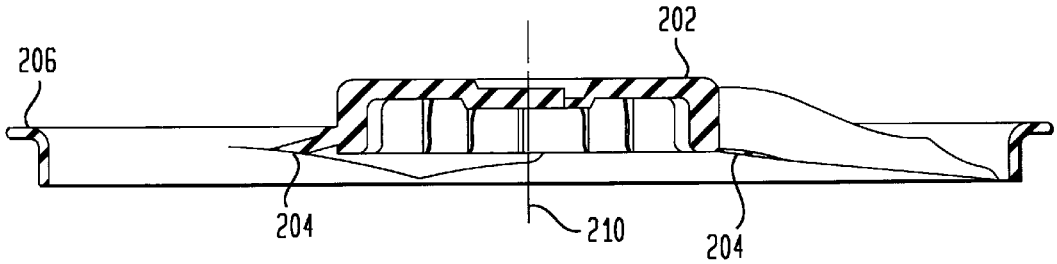
FIG. 9B is a sectional view of the hub, fan blades and circular band taken along line 9B—9B in FIG. 8.
Figure 10A:
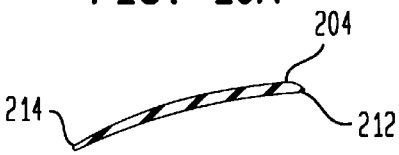
FIG. 10A is a sectional view of a fan blade taken along line 10A—10A in FIG. 6.
Figure 10B:
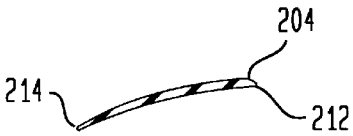
FIG. 10B is a sectional view of a fan blade taken along line 10B—10B in FIG. 6.
Figure 10C:
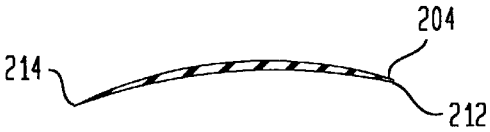
FIG. 10C is a sectional view of a fan blade taken along line 10C—10C in FIG. 6.
Figure 11:
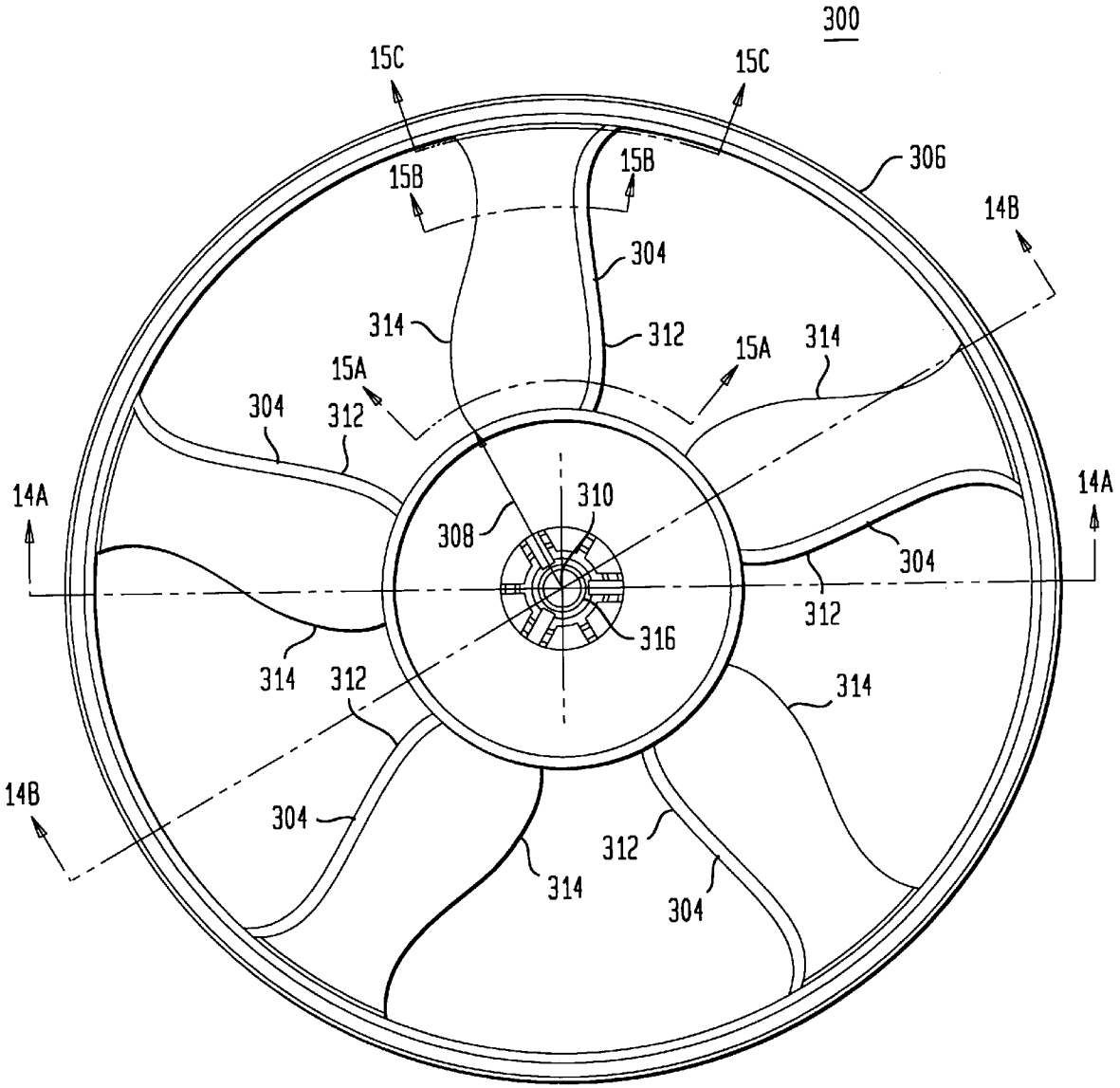
FIG. 11 is a front view of a third embodiment of a fan including a hub, fan blades and a circular band.
Figure 12:
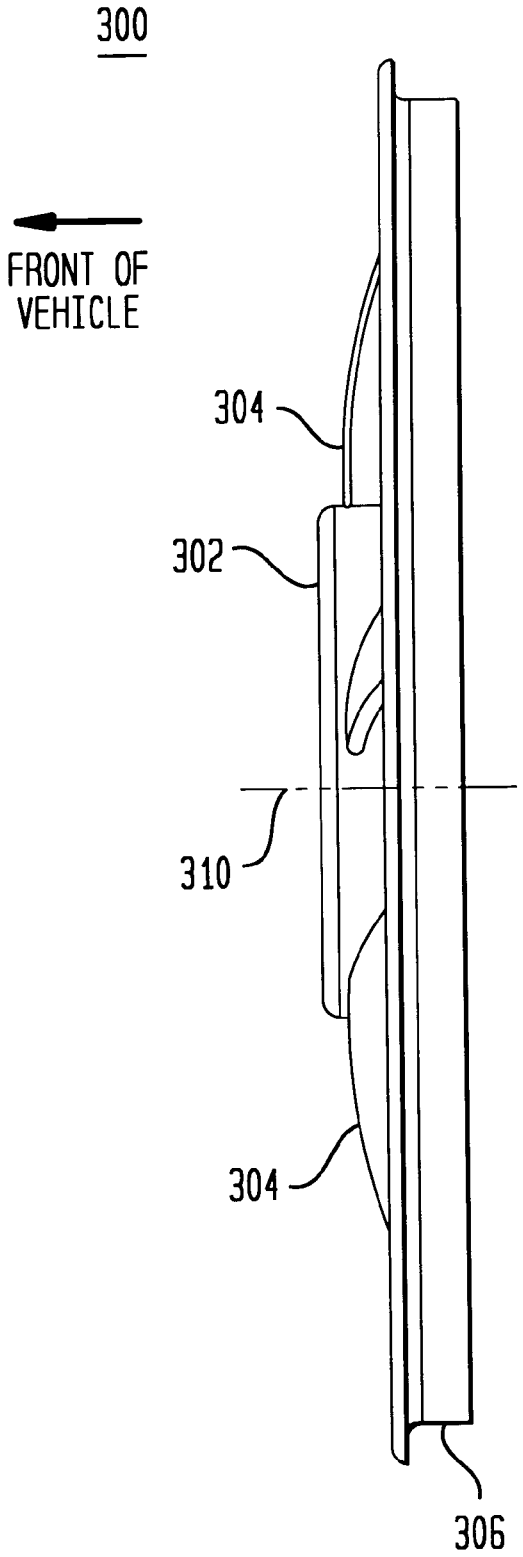
FIG. 12 is a side view of the fan shown in FIG. 11.
Figure 13:
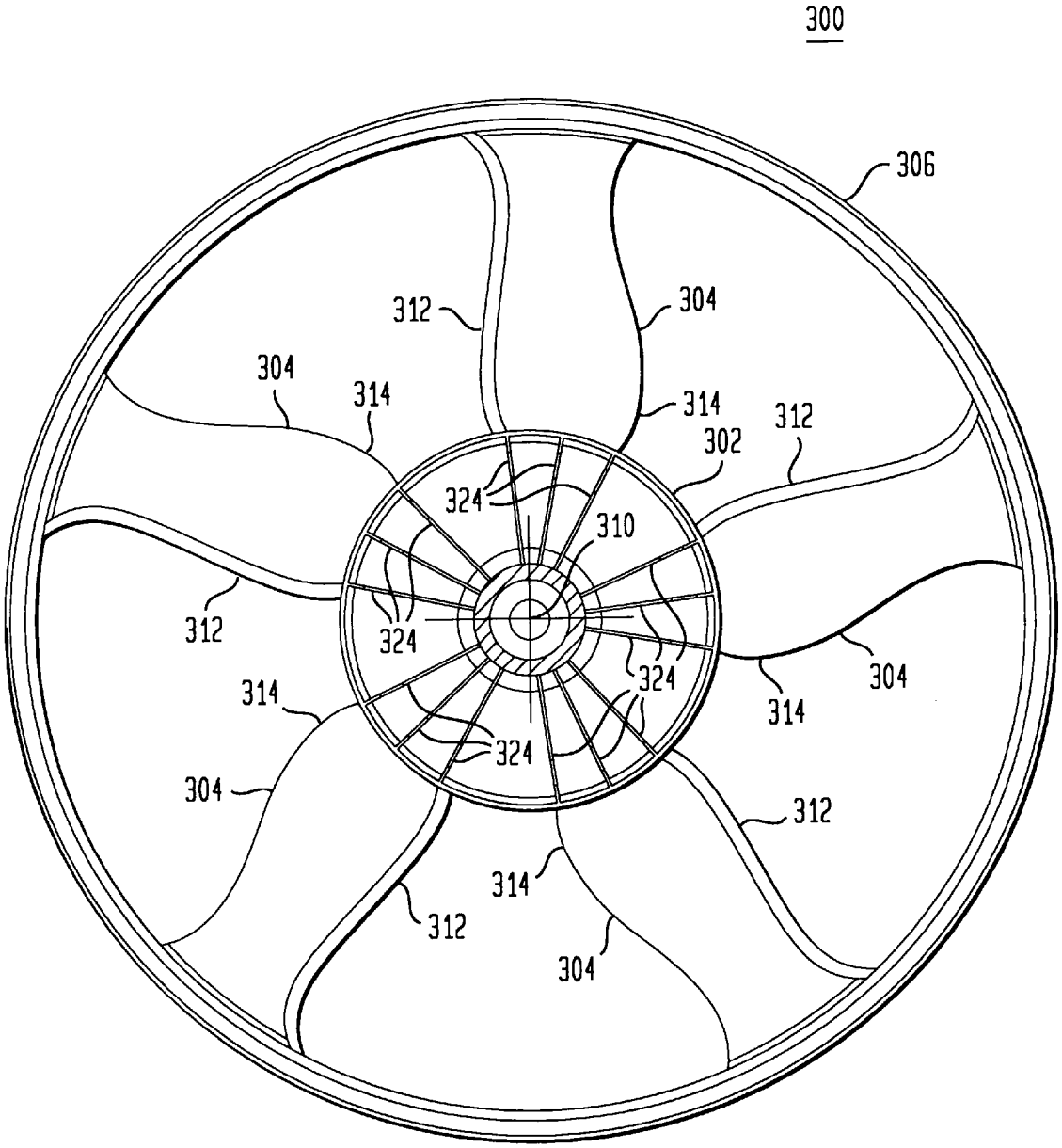
FIG. 13 is a rear view of the fan shown in FIG. 11.
Figure 14A:
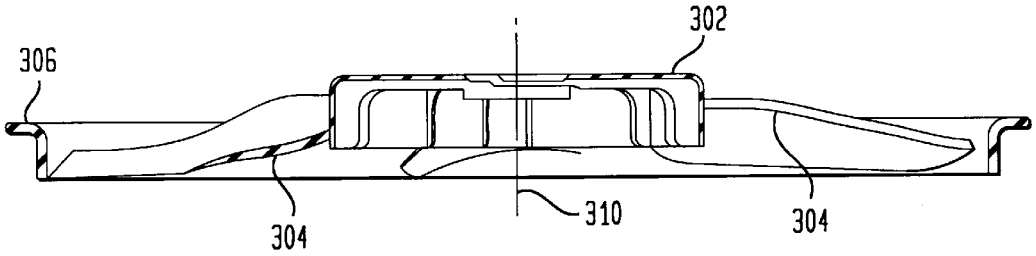
FIG. 14A is a sectional view of the hub, fan blades and circular band taken along line 14A—14A in FIG. 11.
Figure 14B:
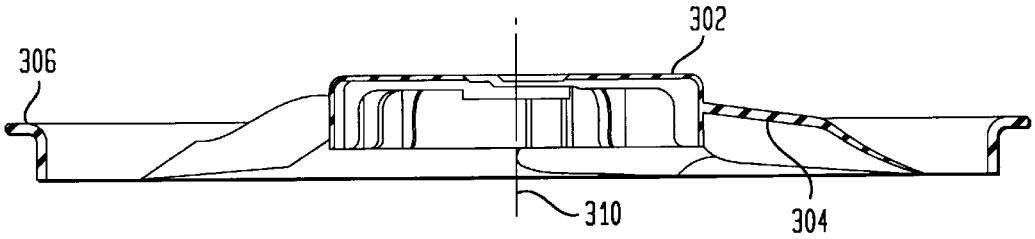
FIG. 14B is a sectional view of the hub, fan blades and circular band taken along line 14B—14B in FIG. 11.
Figure 15A:
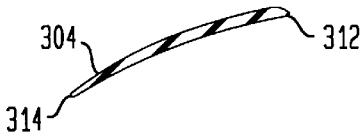
FIG. 15A is a sectional view of a fan blade taken along line 15A—15A in FIG. 11.
Figure 15B:
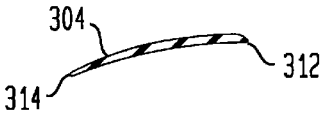
FIG. 15B is a sectional view of a fan blade taken along line 15B—15B in FIG. 11.
Figure 15C:
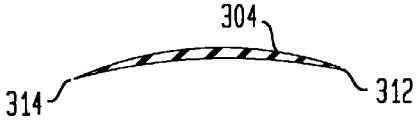
FIG. 15C is a sectional view of a fan blade taken along line 15C—15C in FIG. 11.

Referring to FIG. 8, hub 202 includes three reinforcement spars 224 located generally in the vicinity of leading edge 212, trailing edge 214 and a location therebetween. Spars 224 provide rigidity to fan 200, which aids in reducing vibration noise during operation of fan 200.

As with fan 100, fan 200 has four fan blades 204. Blades 204 of fan 200 are configured to produce low flow rate and high pressure rise performance characteristics. In particular, each blade 204 has the following parameters:

TABLE II

| R (mm) | $R/R_{tip}$ | C (mm) | ϵ (deg) | Θ (deg) | σ |
|---|---|---|---|---|---|
| 75.00 | 0.40 | 55.00 | 77.00 | 30.00 | 0.47 |
| 86.19 | 0.46 | 65.00 | 75.00 | 29.70 | 0.48 |
| 99.80 | 0.53 | 69.00 | 74.00 | 29.50 | 0.44 |
| 113.56 | 0.60 | 67.50 | 74.20 | 29.50 | 0.38 |
| 127.25 | 0.67 | 63.00 | 74.50 | 29.50 | 0.32 |
| 140.94 | 0.75 | 57.90 | 74.80 | 29.50 | 0.26 |
| 154.00 | 0.82 | 54.50 | 76.50 | 29.50 | 0.23 |
| 168.31 | 0.89 | 54.70 | 78.20 | 29.50 | 0.21 |
| 182.00 | 0.96 | 61.00 | 80.30 | 30.00 | 0.21 |
| 188.84 | 1.00 | 70.00 | 81.50 | 30.80 | 0.24 |
| 197.50 | 1.05 | 90.00 | 83.00 | 33.00 | 0.29 |

wherein R is the radial distance from rotational axis 210, $R/R_{tip}$ is a dimensionless radial distance based on blade tip section radii, C is the chord length, ϵ is the stagger angle, θ is the camber angle, and σ is the solidity C/S (S being the circumferential blade spacing) at the radial distance R.

A third embodiment of a fan 300 in accordance with the present invention is shown in FIGS. 11 through 15C. The description of fan 300 is generally similar to fan 200, except as discussed herein. The reference numerals in FIGS. 11 through 15 generally correspond to the reference numerals of FIGS. 6 through 10C, except that the numerals start at a base of 300 rather than 200.

Fan 300 has five fan blades 304 configured to produce low flow rate and high pressure rise performance characteristics. In particular, each blade 304 has the following parameters:

TABLE III

| R (mm) | $R/R_{tip}$ | C (mm) | $\epsilon$ (deg) | $\Theta$ (deg) | $\sigma$ |
|---|---|---|---|---|---|
| 75.00 | 0.40 | 56.00 | 72.00 | 28.00 | 0.59 |
| 86.19 | 0.46 | 65.00 | 70.60 | 28.40 | 0.60 |
| 99.80 | 0.53 | 70.80 | 70.90 | 28.60 | 0.56 |
| 113.56 | 0.60 | 70.00 | 71.70 | 28.40 | 0.49 |
| 127.25 | 0.67 | 66.00 | 73.00 | 28.20 | 0.41 |
| 140.94 | 0.75 | 57.90 | 74.00 | 28.00 | 0.33 |
| 154.00 | 0.82 | 53.00 | 75.80 | 27.80 | 0.27 |
| 168.31 | 0.89 | 50.00 | 76.30 | 27.80 | 0.24 |
| 182.00 | 0.96 | 52.40 | 81.40 | 28.50 | 0.23 |
| 188.84 | 1.00 | 60.00 | 83.70 | 28.90 | 0.25 |
| 196.10 | 1.04 | 80.00 | 86.80 | 30.00 | 0.32 |

wherein R is the radial distance from rotational axis 310, $R/R_{tip}$ is a dimensionless radial distance based on blade tip section radii, C is the chord length, $\epsilon$ is the stagger angle, $\theta$ is the camber angle, and $\sigma$ is the solidity C/S (S being the circumferential blade spacing) at the radial distance R.

Figure 16:
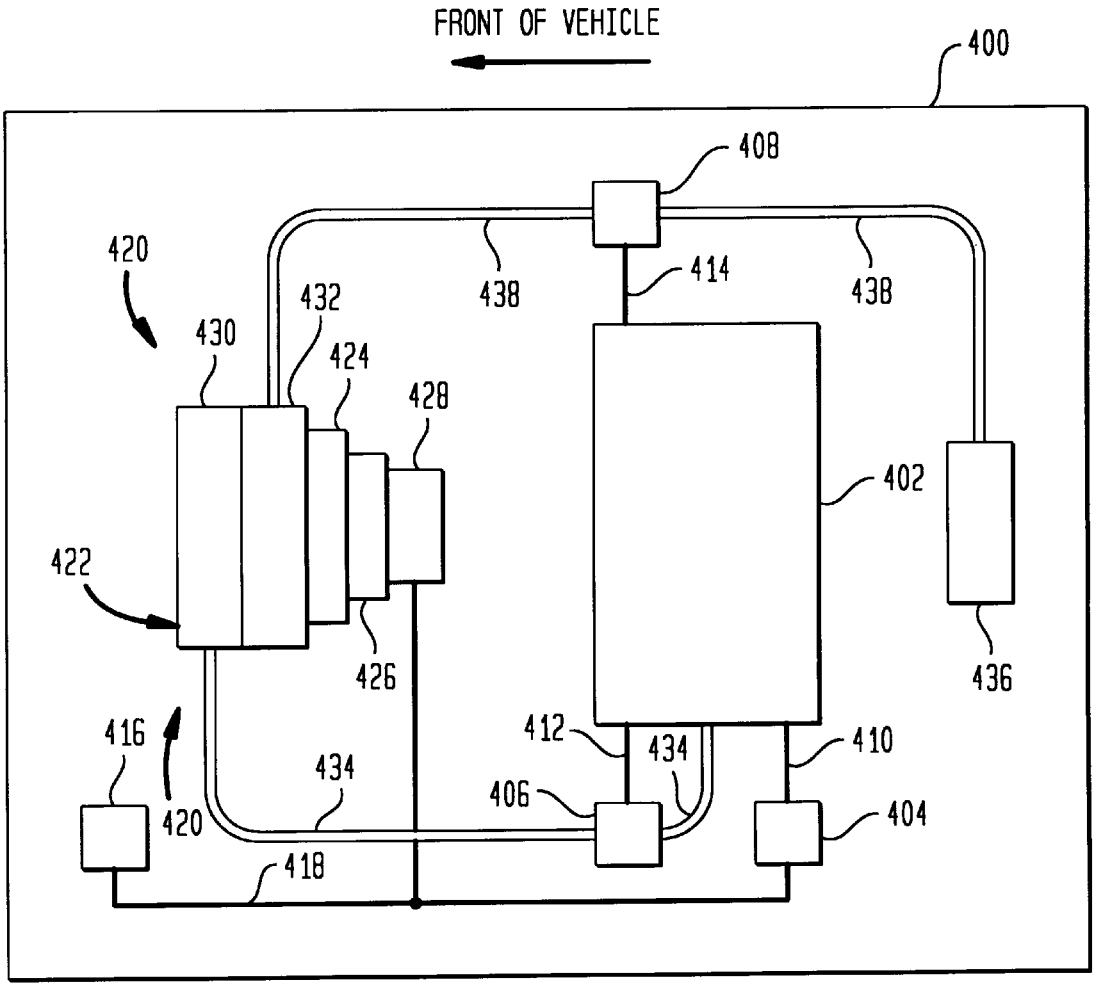
FIG. 16 is a top view of the engine compartment of a vehicle including an engine and a cooling system.

Referring to FIG. 16, an engine compartment 400 of a vehicle houses an engine 402 configured to drive a generator 404, a coolant pump 406 and a cooling compressor 408 through appropriate gearings or transmissions 410, 412 and 414, respectively. The gearings may include belts, chains or direct coupling drives. Generator 404 is coupled to a battery 416 via electrical conductors 418.

Engine compartment 400 also houses a vehicle cooling system 420 which includes a heat exchanger assembly 422, and a module comprising a shroud 424, a fan 426, and an electric motor 428. Assembly 422 includes one or more heat exchangers, such as an engine cooling heat exchanger 430 and an air conditioning heat exchanger 432, configured to transfer heat from a vehicle system to air flowing past or through the heat exchangers. An engine coolant (not shown) is circulated by pump 406 between engine 402 and engine cooling heat exchanger 430 via hoses 434. An air-conditioning coolant (not shown) is circulated by cooling compressor 408 between a cooling coil 436 and air conditioning heat exchanger 432 via hoses 438. Fan 426 is in accordance with the present invention as described in detail above.

Electric motor 428 receives electrical power via conductors 418 from battery 416 or generator 404. Battery 416 allows motor 428 to operate regardless of whether engine 402 is in operation. A switch (not shown) coupled to a control system including engine and passenger compartment temperature sensors controls operation of motor 428. Motor 428 includes a shaft (not shown) which drives fan 426, such that motor 428 rotatably supports and powers fan 426. FIG. 16 shows fan 426 and motor 428 located on the downstream side of heat exchanger assembly 422. Such an arrangement is referred to as a puller system since air is pulled through heat exchanger assembly 422. However, fan 426 and motor 428 could also be located upstream of heat exchanger assembly 422 in an arrangement referred to as a pusher system since air would be pushed through the heat exchanger.

Shroud 424 extends between heat exchanger assembly 422 and fan 426 and guides an airflow produced by fan 426 past or through assembly 422. Shroud 424 provides a mechanical seal for air flowing between fan 426 and assembly 422, thereby increasing the efficiency of the cooling system. If the dimensions of engine compartment 400 are suitable, a duct could extend between fan 426 and assembly 422.

In operation, the electrical system including generator 404, battery 416 and conductors 418 provide electrical power to motor 428. When power is applied, motor 428 rotates the shaft (not shown) and causes the blades of fan 426 to produce an airflow in a direction generally opposite to the arrow labeled "FRONT OF VEHICLE" in FIG. 16. This airflow either pushes or pulls air through heat exchanger assembly 422, thereby removing heat energy from the liquid flowing through assembly 422.

While the embodiments illustrated in the FIGURES and described above are presently preferred, it should be understood that these embodiments are offered by way of example only. For example, other embodiments may have a different number of fan blades, or may have different parameter values than those listed for the three fan embodiments described herein. For another example, the accuracy of the parameter values in Tables I, II and III is not intended to limit the scope of the invention. The invention is not intended to be limited to any particular embodiment, but is intended to extend to various modifications that nevertheless fall within the scope of the appended claims.

What is claimed is:

1. A fan rotatable about a rotational axis comprising:

a plurality of radially-extending fan blades configured to produce an airflow when rotated about the rotational axis, each blade having a chord length distribution which varies along the length of the blade, wherein the chord length has a local minimum value at a predetermined location between the ends of the blade.

2. The fan of claim 1 wherein the chord length, as a function of blade radius from the rotational axis, has an inflection point at a predetermined location between the ends of the blade.

3. The fan of claim 1 wherein the solidity value as a function of blade radius from the rotational axis ranges between approximately 0.17 and 0.52.

4. The fan of claim 1 wherein the solidity value as a function of blade radius from the rotational axis ranges between approximately 0.21 and 0.48.

5. The fan of claim 1 wherein the solidity value as a function of blade radius from the rotational axis ranges between approximately 0.23 and 0.60.

6. The fan of claim 1 including four blades.

7. The fan of claim 1 including five blades.

8. The fan of claim 1 further comprising a hub and a circular band concentric with the hub and spaced radially outward from the hub, wherein the blades are distributed circumferentially around the hub and extend from the hub to the circular band.

9. The fan of claim 8 wherein the circular band has an L-shaped cross-section taken along a plane passing through the rotational axis.

10. The fan of claim 8 wherein the hub, blades and circular band are an integral piece.

11. A fan comprising:

a hub rotatable about a rotational axis; and a plurality of fan blades having proximal and distal ends, said proximal ends being connected to the hub so that each blade may extend radially from the hub, said blades being configured to produce an air flow when rotated about the rotational axis, each blade having a chord length distribution which varies along the length of the blade, wherein the chord length, as a function of blade radius from the rotational axis, has an inflection point at a predetermined distance from the hub less than the length of the blade and has a local minimum between the inflection point and the distal end of the blade.

12. The fan of claim 11 wherein the solidity value as a function of blade radius from the rotational axis is relatively low.

13. The fan of claim 11 including four blades.

14. The fan of claim 11 including five blades.

15. The fan of claim 11 further comprising a circular band concentric with the hub and spaced radially outward from the hub, wherein the blades are distributed circumferentially around the hub and extend from the hub to the circular band.

16. The fan of claim 15 wherein the circular band has an L-shaped cross-section taken along a plane passing through the rotational axis.

17. The fan of claim 15 wherein the hub, blades and circular band are an integral piece.

18. A fan comprising:

a hub rotatable about a rotational axis; and a plurality of fan blades extending radially from the hub and configured to produce an airflow when rotated about the rotational axis, each blade having a chord length distribution which varies along the length of the blade, wherein the second derivative of the chord length, as a function of blade radius from the rotational axis, is substantially equal to zero at a predetermined distance from the hub less than the length of the blade.

19. The fan of claim 18 wherein the solidity value as a function of blade radius from the rotational axis is relatively low.

20. The fan of claim 18 further comprising a circular band concentric with the hub and spaced radially outward from the hub, wherein the blades are distributed circumferentially around the hub and extend from the hub to the circular band.

21. A high efficiency, low solidity, low weight, axial flow fan for producing an airflow through an engine compartment of a vehicle comprising:

a hub rotatable about a rotational axis;

a circular band concentric with the hub and spaced radially outward from the hub; and four fan blades distributed circumferentially around the hub and extending radially from the hub to the circular band, wherein each blade has substantially the parameters defined by

| R (mm) | $R/R_{tip}$ | C (mm) | ϵ (deg) | Θ (deg) | σ |
|---|---|---|---|---|---|
| 75.00 | 0.40 | 56.00 | 67.63 | 19.00 | 0.48 |
| 86.19 | 0.46 | 70.11 | 67.00 | 20.00 | 0.52 |
| 99.80 | 0.53 | 76.16 | 66.73 | 24.00 | 0.49 |
| 113.56 | 0.60 | 74.00 | 67.00 | 23.00 | 0.41 |
| 127.25 | 0.67 | 66.76 | 67.80 | 22.30 | 0.33 |
| 140.94 | 0.75 | 57.58 | 69.00 | 22.00 | 0.26 |
| 157.00 | 0.83 | 49.61 | 71.00 | 21.00 | 0.20 |
| 168.31 | 0.89 | 46.00 | 73.00 | 21.00 | 0.17 |
| 182.82 | 0.97 | 49.87 | 76.39 | 21.50 | 0.17 |
| 188.84 | 1.00 | 55.59 | 78.00 | 23.00 | 0.19 |
| 196.10 | 1.04 | 65.00 | 80.00 | 24.00 | 0.21 |

wherein

R is the radial distance from the rotational axis, $R/R_{tip}$ is the dimensionless radial distance based on blade tip section radii, C is the chord length of the blade at the radial distance R, ϵ is the stagger angle of the blade at the radial distance R, θ is the camber angle of the blade at the radial distance R, and σ is the solidity C/S, S being the circumferential blade spacing, at the radial distance R.

22. A high efficiency, low solidity, low weight, axial flow fan for producing an airflow through an engine compartment of a vehicle comprising:

a hub rotatable about a rotational axis;

a circular band concentric with the hub and spaced radially outward from the hub; and four fan blades distributed circumferentially around the hub and extending radially from the hub to the circular band, wherein each blade has substantially the parameters defined by

| R (mm) | $R/R_{tip}$ | C (mm) | ϵ (deg) | Θ (deg) | σ |
|---|---|---|---|---|---|
| 75.00 | 0.40 | 55.00 | 77.00 | 30.00 | 0.47 |
| 86.19 | 0.46 | 65.00 | 75.00 | 29.70 | 0.48 |
| 99.80 | 0.53 | 69.00 | 74.00 | 29.50 | 0.44 |
| 113.56 | 0.60 | 67.50 | 74.20 | 29.50 | 0.38 |
| 127.25 | 0.67 | 63.00 | 74.50 | 29.50 | 0.32 |
| 140.94 | 0.75 | 57.90 | 74.80 | 29.50 | 0.26 |
| 154.00 | 0.82 | 54.50 | 76.50 | 29.50 | 0.23 |
| 168.31 | 0.89 | 54.70 | 78.20 | 29.50 | 0.21 |
| 182.00 | 0.96 | 61.00 | 80.30 | 30.00 | 0.21 |
| 188.84 | 1.00 | 70.00 | 81.50 | 30.80 | 0.24 |
| 197.50 | 1.05 | 90.00 | 83.00 | 33.00 | 0.29 |

wherein

R is the radial distance from the rotational axis, $R/R_{tip}$ is the dimensionless radial distance based on blade tip section radii, C is the chord length of the blade at the radial distance R, ϵ is the stagger angle of the blade at the radial distance R, θ is the camber angle of the blade at the radial distance R, and σ is the solidity C/S, S being the circumferential blade spacing, at the radial distance R.

23. A high efficiency, low solidity, low weight, axial flow fan for producing an airflow through an engine compartment of a vehicle comprising:

a hub rotatable about a rotational axis;

a circular band concentric with the hub and spaced radially outward from the hub; and five fan blades distributed circumferentially around the hub and extending radially from the hub to the circular band, wherein each blade has substantially the parameters defined by

| R (mm) | $R/R_{tip}$ | C (mm) | ϵ (deg) | Θ (deg) | σ |
|---|---|---|---|---|---|
| 75.00 | 0.40 | 56.00 | 72.00 | 28.00 | 0.59 |
| 86.19 | 0.46 | 65.00 | 70.60 | 28.40 | 0.60 |
| 99.80 | 0.53 | 70.80 | 70.90 | 28.60 | 0.56 |
| 113.56 | 0.60 | 70.00 | 71.70 | 28.40 | 0.49 |
| 127.25 | 0.67 | 66.00 | 73.00 | 28.20 | 0.41 |
| 140.94 | 0.75 | 57.90 | 74.00 | 28.00 | 0.33 |
| 154.00 | 0.82 | 53.00 | 75.80 | 27.80 | 0.27 |
| 168.31 | 0.89 | 50.00 | 76.30 | 27.80 | 0.24 |
| 182.00 | 0.96 | 52.40 | 81.40 | 28.50 | 0.23 |
| 188.84 | 1.00 | 60.00 | 83.70 | 28.90 | 0.25 |
| 196.10 | 1.04 | 80.00 | 86.80 | 30.00 | 0.32 |

wherein

R is the radial distance from the rotational axis, $R/R_{tip}$ is the dimensionless radial distance based on blade tip section radii, C is the chord length of the blade at the radial distance R, ϵ is the stagger angle of the blade at the radial distance R, θ is the camber angle of the blade at the radial distance R, and σ is the solidity C/S, S being the circumferential blade spacing, at the radial distance R.

24. A vehicle cooling system comprising:

a heat exchanger configured to transfer heat from a vehicle system; and a powered fan configured to move air past the heat exchanger, the fan including a plurality of radially-extending fan blades configured to produce an airflow when rotated about a rotational axis, each blade having a chord length distribution which varies along the length of the blade, wherein the chord length has a local minimum value at a predetermined location between the ends of the blade.

25. The cooling system of claim 24 further comprising an electric motor, wherein the fan is rotatably supported and powered by the electric motor.

26. The cooling system of claim 24 further comprising a shroud for guiding the airflow past the heat exchanger.

27. The cooling system of claim 24 wherein the fan further comprises a hub and a circular band concentric with the hub and spaced radially outward from the hub, wherein the blades are distributed circumferentially around the hub and extend from the hub to the circular band.

28. The cooling system of claim 27 wherein the hub, blades and circular band are an integral piece.

29. A vehicle cooling system comprising:

a heat exchanger configured to transfer heat from a vehicle system; and a powered fan configured to move air past the heat exchanger, the fan including a hub rotatable about a rotational axis and a plurality of fan blades extending radially from the hub and configured to produce an air flow when rotated about the rotational axis, each blade having a chord length distribution which varies along the length of the blade, wherein the chord length, as a function of blade radius from the rotational axis, has an inflection point at a predetermined distance from the hub less than the length of the blade, said inflection point being located alone a length of each blade where a second derivative of chord length as a function of blade radius is substantially equal to zero.

30. The cooling system of claim 29 further comprising an electric motor, wherein the fan is rotatably supported and powered by the electric motor.

31. The cooling system of claim 29 further comprising a shroud for guiding the airflow past the heat exchanger.

32. The cooling system of claim 29 wherein the fan further comprises a circular band concentric with the hub and spaced radially outward from the hub, wherein the blades are distributed circumferentially around the hub and extend from the hub to the circular band.

33. The cooling system of claim 32 wherein the hub, blades and circular band are an integral piece.

* * * * *